US012389943B2

(12) United States Patent
Jeong et al.

(10) Patent No.: US 12,389,943 B2
(45) Date of Patent: Aug. 19, 2025

(54) POROUS WICK AND VAPORIZER AND AEROSOL GENERATION DEVICE INCLUDING THE SAME

(71) Applicant: KT&G CORPORATION, Daejeon (KR)

(72) Inventors: Jong Seong Jeong, Daejeon (KR); Chul Ho Jang, Daejeon (KR); Gyoung Min Go, Daejeon (KR); Hyung Jin Bae, Daejeon (KR); Jang Won Seo, Daejeon (KR); Min Seok Jeong, Daejeon (KR); Jin Chul Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 824 days.

(21) Appl. No.: 17/297,090

(22) PCT Filed: Dec. 21, 2020

(86) PCT No.: PCT/KR2020/018744
§ 371 (c)(1),
(2) Date: May 26, 2021

(87) PCT Pub. No.: WO2021/153906
PCT Pub. Date: Aug. 5, 2021

(65) Prior Publication Data

US 2022/0400756 A1 Dec. 22, 2022

(30) Foreign Application Priority Data

Jan. 31, 2020 (KR) ..... 10-2020-0011899

(51) Int. Cl.
*A24F 40/44* (2020.01)
*A24F 40/10* (2020.01)
(Continued)

(52) U.S. Cl.
CPC ..... *A24F 40/44* (2020.01); *A24F 40/10* (2020.01); *A24F 40/42* (2020.01); *A24F 40/46* (2020.01)

(58) Field of Classification Search
CPC ..... A24F 40/10; A24F 40/42; A24F 40/44; A24F 40/46
See application file for complete search history.

(56) References Cited

U.S. PATENT DOCUMENTS 4,093,771 A * 6/1978 Fletcher ..... C03C 1/00 428/920
2002/0104836 A1* 8/2002 Goodsel ..... H05B 3/265 338/308
(Continued)

FOREIGN PATENT DOCUMENTS

CN 109349680 A 2/2019
KR 10-2016-0040440 A 4/2016
(Continued)

OTHER PUBLICATIONS

International Search Report for PCT/KR2020/018744 dated Apr. 8, 2021 [PCT/ISA/210].
(Continued)

*Primary Examiner* — Sang Y Paik
(74) *Attorney, Agent, or Firm* — Sughrue Mion, PLLC

(57) ABSTRACT

Provided herein are a porous wick and a vaporizer and aerosol generation device including the same. The vaporizer according to some embodiments of the present disclosure includes a liquid reservoir configured to store an aerosol-generating substrate in a liquid state, a heating element configured to heat the stored aerosol-generating substrate to generate an aerosol, and a porous wick configured to deliver the stored aerosol-generating substrate to the heating element through a porous body and comprising a coating film formed on at least a part of a plurality of surfaces of the
(Continued)

porous body. Since a coating film is formed on a surface not associated with a target transport path for a liquid, the liquid can be intensively transported along the target transport path.

11 Claims, 10 Drawing Sheets

(51) Int. Cl.
*A24F 40/42* (2020.01)
*A24F 40/46* (2020.01)

(56) References Cited

U.S. PATENT DOCUMENTS

| | | | | |
|---|---|---|---|---|
| 2017/0188626 | A1* | 7/2017 | Davis | A24F 40/40 |
| 2018/0007974 | A1* | 1/2018 | Thorens | A24F 40/42 |
| 2018/0279673 | A1 | 10/2018 | Sebastian et al. | |
| 2018/0279686 | A1* | 10/2018 | Macko | A24F 40/46 |
| 2018/0360119 | A1 | 12/2018 | Kuwa et al. | |
| 2019/0350256 | A1* | 11/2019 | Hejazi | A24F 40/485 |
| 2021/0401061 | A1* | 12/2021 | Davis | A24F 40/57 |
| 2022/0039470 | A1* | 2/2022 | Courbat | A24F 40/42 |

FOREIGN PATENT DOCUMENTS

| | | | |
|---|---|---|---|
| KR | 10-2018-0044407 | A | 5/2018 |
| KR | 10-2019-0019055 | A | 2/2019 |
| KR | 10-2019-0100354 | A | 8/2019 |
| WO | 2018/220599 | A1 | 12/2018 |
| WO | 2019/000486 | A1 | 1/2019 |
| WO | 2019/193310 | A1 | 10/2019 |

OTHER PUBLICATIONS

Extended European Search Report issued Nov. 11, 2021 in European Application No. 20866931.7.

* cited by examiner

[FIG. 1]
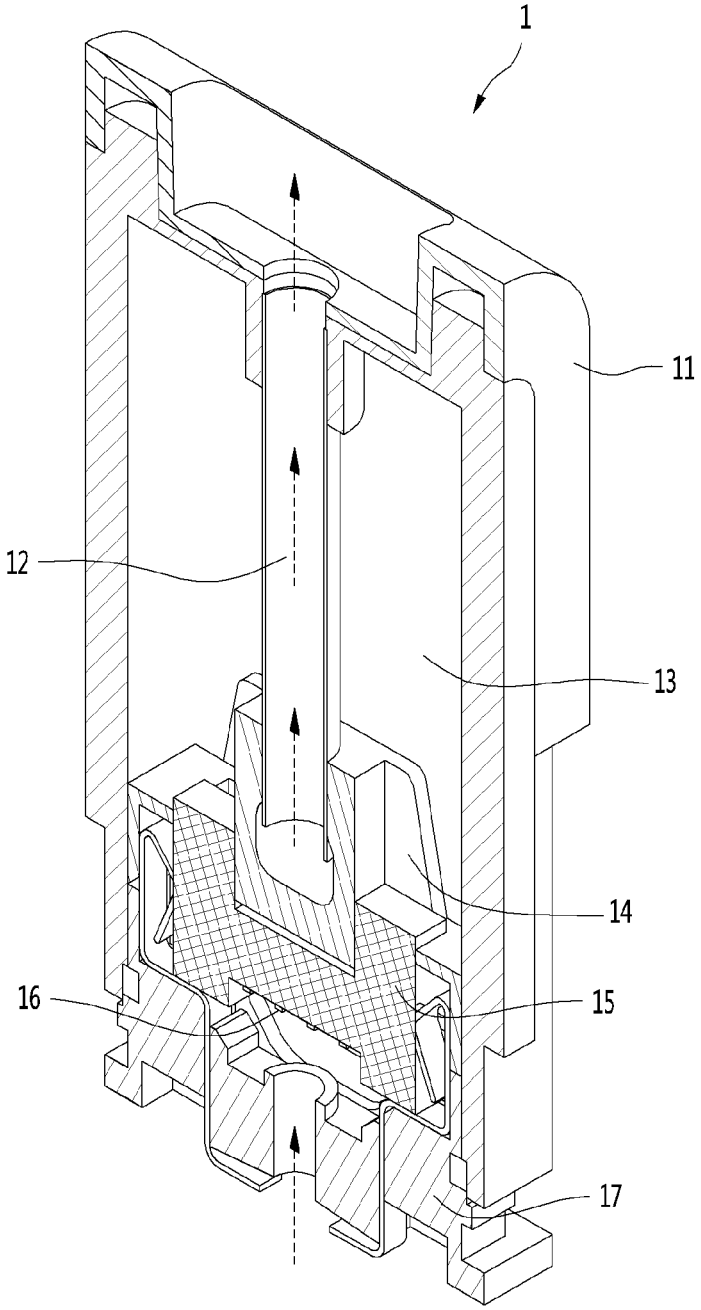

[FIG. 2]
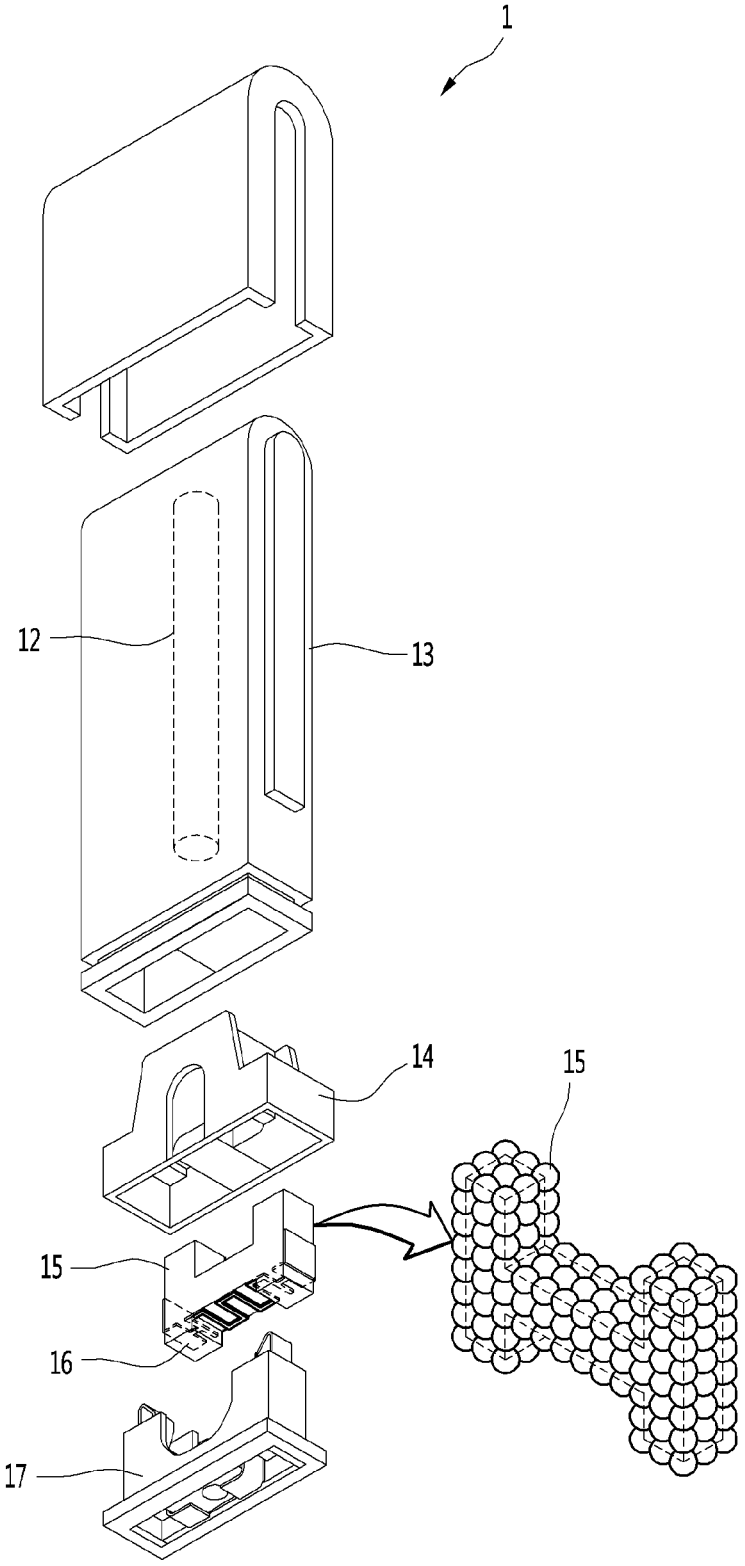

[FIG. 3]
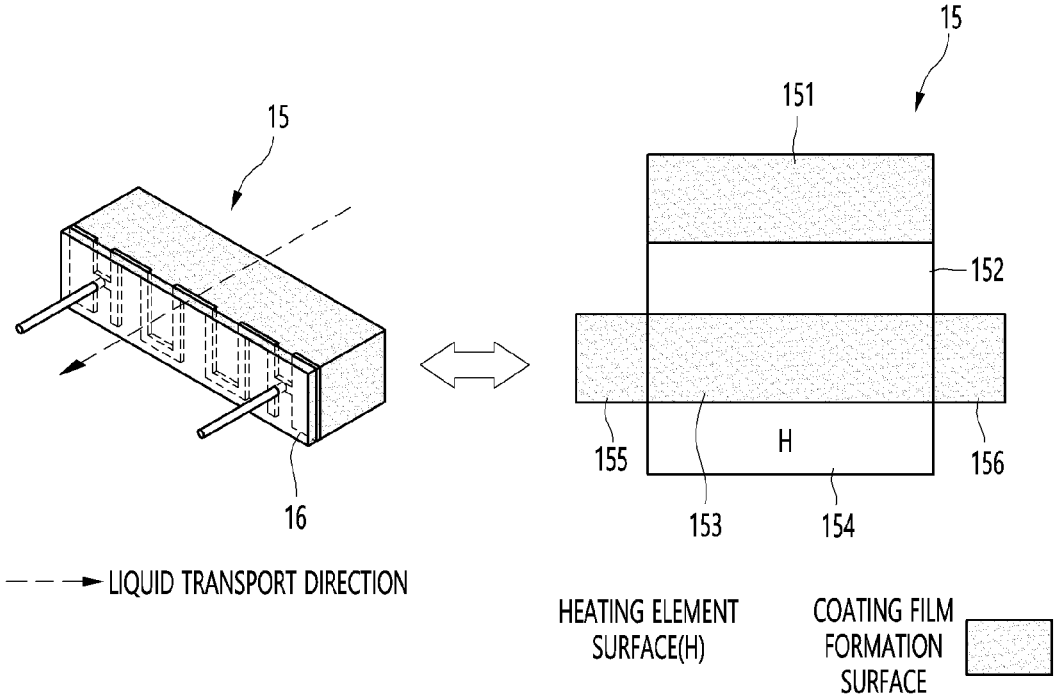

[FIG. 4]
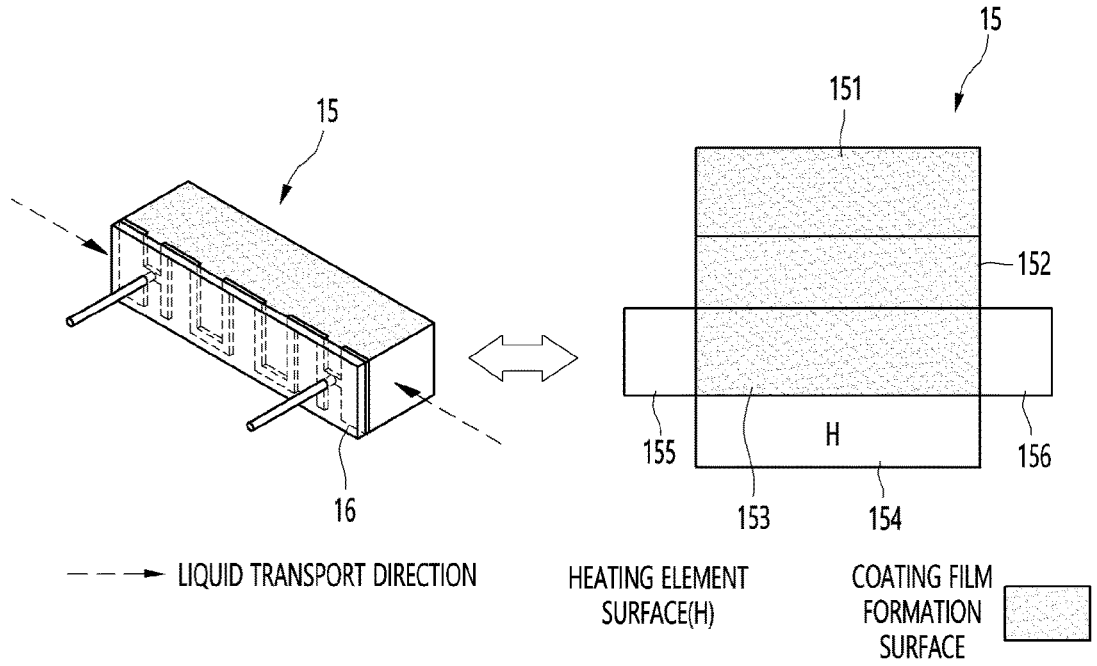

[FIG. 5]
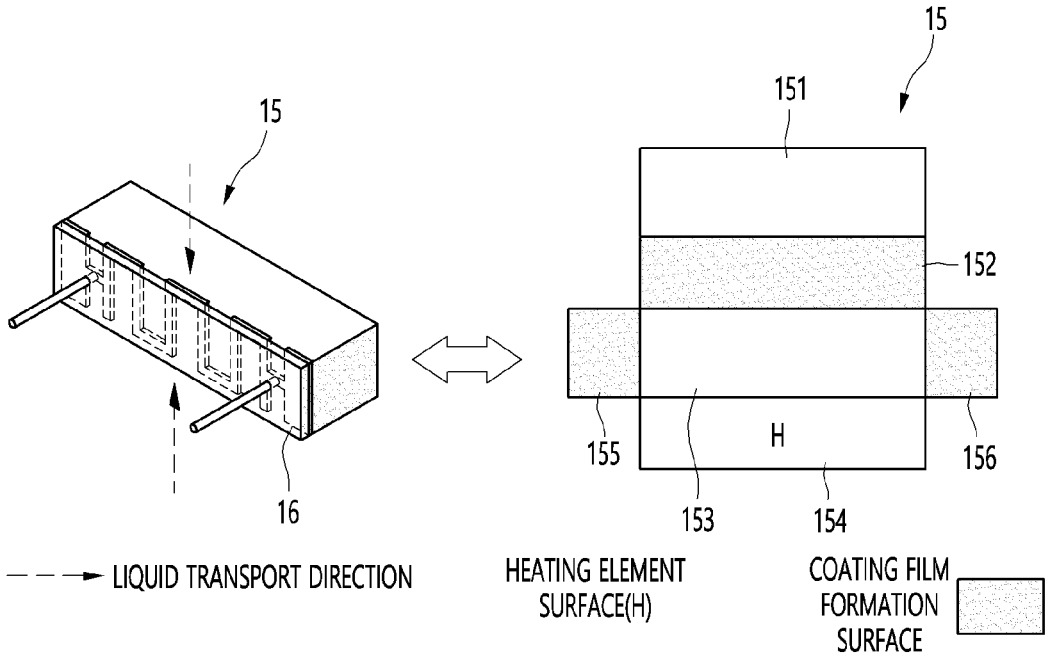

[FIG. 6]
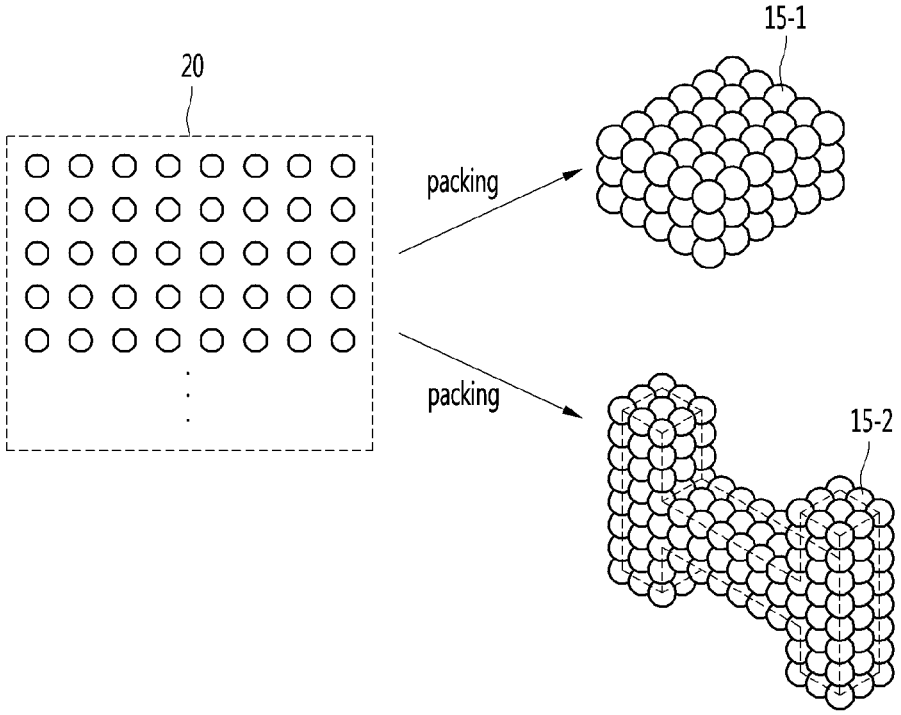

[FIG. 7]
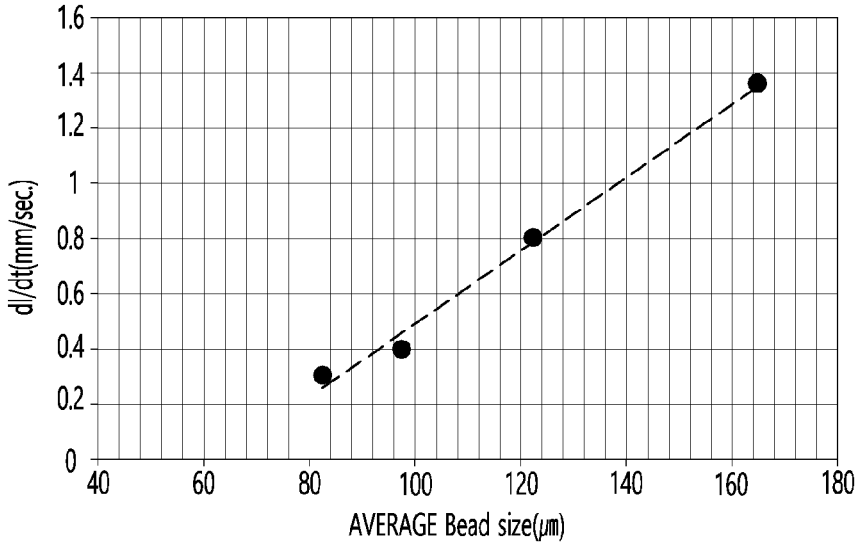
[FIG. 8]
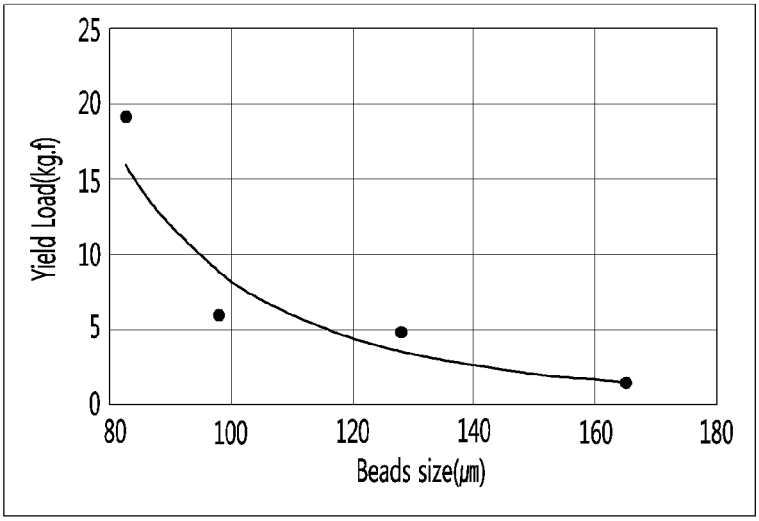

[FIG. 9]
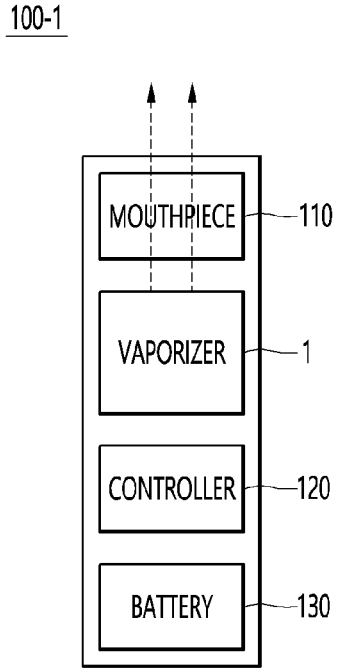

[FIG. 10]
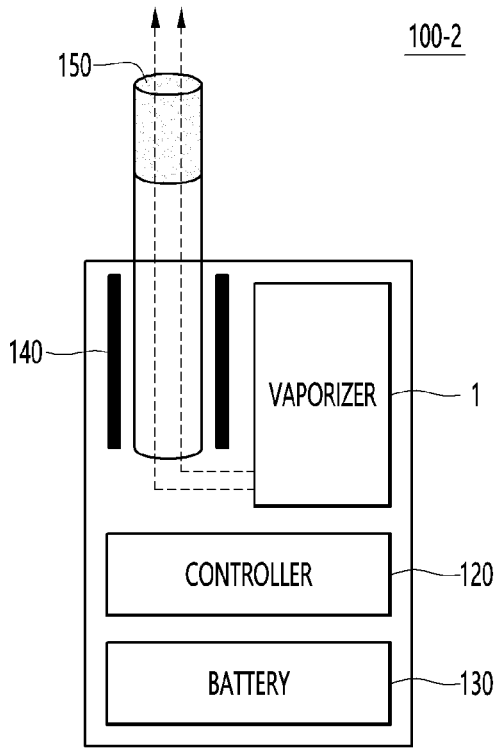

[FIG. 11]
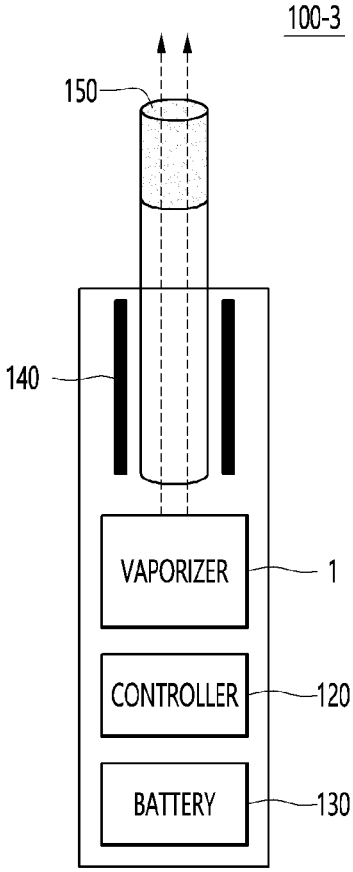

POROUS WICK AND VAPORIZER AND AEROSOL GENERATION DEVICE INCLUDING THE SAME

CROSS REFERENCE TO RELATED APPLICATIONS

This application is a National Stage of International Application No. PCT/KR2020/018744 filed Dec. 21, 2020, claiming priority based on Korean Patent Application No. 10-2020-0011899 filed Jan. 31, 2020.

TECHNICAL FIELD

The present disclosure relates to a porous wick and a vaporizer and aerosol generation device including the same, and more particularly, to a porous wick, which is designed to intensively transport a liquid along a target transport path, and a vaporizer and aerosol generation device including the same.

BACKGROUND ART

In recent years, demand for alternative smoking articles that overcome the disadvantages of general cigarettes has increased. For example, instead of cigarettes, demand for aerosol generation devices that vaporize liquid compositions to generate an aerosol has increased, and accordingly, active research has been carried out on liquid vaporization-type aerosol generation devices.

In the liquid vaporization-type aerosol generation device, a wick is one of the key components of the device and serves to absorb a liquid and deliver the liquid to a heating element (e.g., heater). Recently, a wick having a porous structure (so-called "porous wick") has been proposed.

However, since the entire body of the porous wick is porous, liquid transport is performed in all directions, and the liquid transport direction cannot be controlled as desired. That is, since the liquid is not intensively transported to a target destination (e.g., heating element), the liquid transport ability and vapor production may not be improved as expected even when the porous wick is used.

DISCLOSURE

Technical Problem

Some embodiments of the present disclosure are directed to providing a porous wick, which is designed to intensively transport a liquid along a target transport path, and a vaporizer and aerosol generation device including the same.

Some embodiments of the present disclosure are also directed to providing a porous wick, which is capable of guaranteeing uniformity in liquid transport speed and amount of transported liquid, and a vaporizer and aerosol generation device including the same.

Objectives of the present disclosure are not limited to the above-mentioned objectives, and other unmentioned objectives may be clearly understood by those of ordinary skill in the art to which the present disclosure pertains from the description below.

Technical Solution

A vaporizer according to some embodiments of the present disclosure includes a liquid reservoir configured to store an aerosol-generating substrate in a liquid state, a heating element configured to heat the stored aerosol-generating substrate to generate an aerosol, and a porous wick configured to deliver the stored aerosol-generating substrate to the heating element through a porous body and comprising a coating film formed on at least a part of a plurality of surfaces of the porous body.

In some embodiments, the part of the plurality of surfaces may include at least one surface that is not associated with a target transport path for the aerosol-generating substrate.

In some embodiments, the heating element may include a heating pattern having a planar form, the heating pattern may be disposed on at least one surface of the plurality of surfaces, and the part of the plurality of surfaces may include a surface on which the heating pattern is not disposed.

In some embodiments, the coating film may be a glass film.

In some embodiments, the porous body may be formed by a plurality of beads.

In some embodiments, the vaporizer may further include an airflow tube disposed in a direction upward from the porous wick and configured to deliver the generated aerosol, and the heating element may be disposed at a lower portion of the porous wick.

In some embodiments, the heating element may include a heating pattern having a planar form, and the heating pattern may be embedded at a depth in a range of 0 μm to 400 μm from a surface of the porous body.

Advantageous Effects

According to various embodiments of the present disclosure, a coating film can be formed on some surfaces that are not associated with a target transport path among a plurality of surfaces forming a body of a porous wick. Accordingly, a liquid can be intensively transported along a target transport path, and a liquid supply ability of the porous wick and vapor production of a vaporizer (or aerosol generation device) can be significantly improved.

Also, since a plurality of beads are packed to form a wick, it is possible to form a porous wick in which the size and/or distribution of pores is uniform. Accordingly, the liquid transport speed and amount of transported liquid can be guaranteed to be uniform, and vapor production of the vaporizer (or aerosol generation device) can also be maintained to be uniform. Further, a carbonization phenomenon of the porous wick can be minimized.

The advantageous effects according to the technical idea of the present disclosure are not limited to the above-mentioned advantageous effects, and other unmentioned advantageous effects should be clearly understood by those of ordinary skill in the art from the description below.

DESCRIPTION OF DRAWINGS

FIG. 1 is an exemplary configuration diagram of a vaporizer according to some embodiments of the present disclosure.

FIG. 2 is an exemplary exploded view of the vaporizer according to some embodiments of the present disclosure.

FIGS. 3 to 5 illustrate a method of controlling a liquid transport path of a porous wick according to some embodiments of the present disclosure.

FIG. 6 is an exemplary view for describing a method of manufacturing a porous wick according to some embodiments of the present disclosure.

FIG. 7 illustrates experimental results relating to a bead size and a liquid transport speed of the porous wick.

FIG. 8 illustrates experimental results relating to a bead size and a strength of the porous wick.

FIGS. 9 to 11 are exemplary block diagrams illustrating an aerosol generation device to which the vaporizer according to some embodiments of the present disclosure is applicable.

MODES OF THE INVENTION

Hereinafter, exemplary embodiments of the present disclosure will be described in detail with reference to the accompanying drawings. Advantages and features of the present disclosure and a method of achieving the same should become clear with embodiments described in detail below with reference to the accompanying drawings. However, the technical idea of the present disclosure is not limited to the following embodiments and may be implemented in various other forms. The embodiments make the technical idea of the present disclosure complete and are provided to completely inform those of ordinary skill in the art to which the present disclosure pertains of the scope of the present disclosure. The technical idea of the present disclosure is defined only by the scope of the claims.

In assigning reference numerals to components of each drawing, it should be noted that the same reference numerals are assigned to the same components as much as possible even when the components are illustrated in different drawings. Also, in describing the present disclosure, when detailed description of a known related configuration or function is deemed as having the possibility of obscuring the gist of the present disclosure, the detailed description thereof will be omitted.

Unless otherwise defined, all terms including technical or scientific terms used herein have the same meaning as commonly understood by those of ordinary skill in the art to which the present disclosure pertains. Terms defined in commonly used dictionaries should not be construed in an idealized or overly formal sense unless expressly so defined herein. Terms used herein are for describing the embodiments and are not intended to limit the present disclosure. In the specification, a singular expression includes a plural expression unless the context clearly indicates otherwise.

Also, in describing components of the present disclosure, terms such as first, second, A, B, (a), and (b) may be used. Such terms are only used for distinguishing one component from another component, and the essence, order, sequence, or the like of the corresponding component is not limited by the terms. In a case in which a certain component is described as being "connected," "coupled," or "linked" to another component, it should be understood that, although the component may be directly connected or linked to the other component, still another component may also be "connected," "coupled," or "linked" between the two components.

The terms "comprises" and/or "comprising" used herein do not preclude the presence of or the possibility of adding one or more components, steps, operations, and/or devices other than those mentioned.

Prior to the description of various embodiments of the present disclosure, some terms used herein will be clarified.

In the present specification, "aerosol-generating substrate" may refer to a material that is able to generate an aerosol. The aerosol may include a volatile compound. The aerosol-generating substrate may be a solid or liquid.

For example, solid aerosol-generating substrates may include solid materials based on tobacco raw materials such as reconstituted tobacco leaves, shredded tobacco, and reconstituted tobacco, and aerosol-generating substrates in a liquid state may include liquid compositions based on nicotine, tobacco extracts, and/or various flavoring agents. However, the scope of the present disclosure is not limited to the above-listed examples.

As a more specific example, the aerosol-generating substrates in a liquid state may include at least one of propylene glycol (PG) and glycerin (GLY) and may further include at least one of ethylene glycol, dipropylene glycol, diethylene glycol, triethylene glycol, tetraethylene glycol, and oleyl alcohol. As another example, the aerosol-generating substrate may further include at least one of nicotine, moisture, and a flavoring material. As still another example, the aerosol-generating substrate may further include various additives such as cinnamon and capsaicin. The aerosol-generating substrate may not only include a liquid material with high fluidity but also include a material in the form of gel or a solid. In this way, as the components constituting the aerosol-generating substrate, various materials may be selected according to embodiments, and composition ratios thereof may also vary according to embodiments. In the following description, "liquid" may be understood as referring to the aerosol-generating substrate in a liquid state.

In the specification, "aerosol generation device" may refer to a device that generates an aerosol using an aerosol-generating substrate in order to generate an aerosol that can be inhaled directly into the user's lungs through the user's mouth. Examples of the aerosol generation device may include a liquid-type aerosol generation device using a vaporizer and a hybrid-type aerosol generation device using a vaporizer and a cigarette together. However, the examples of the aerosol generation device may further include various other kinds of aerosol generation devices, and the scope of the present disclosure is not limited to the above-listed examples. Some examples of the aerosol generation device will be described below with reference to FIGS. 9 to 11.

In the specification, "puff" refers to inhalation by a user, and the inhalation may refer to a situation in which a user draws in smoke into his or her oral cavity, nasal cavity, or lungs through the mouth or nose.

Hereinafter, various embodiments of the present disclosure will be described in detail with reference to the accompanying drawings.

FIG. 1 is an exemplary configuration diagram of a vaporizer 1 according to some embodiments of the present disclosure, and FIG. 2 is an exemplary exploded view of the vaporizer 1. In FIG. 1, dotted arrows represent a delivery path of air or an aerosol.

As illustrated in FIGS. 1 and 2, the vaporizer 1 may include an upper case 11, an airflow tube 12, a liquid reservoir 13, a wick housing 14, a porous wick 15, a heating element 16, and a lower case 17. However, only some components relating to the present embodiment are illustrated in FIG. 1. Therefore, those of ordinary skill in the art to which the present disclosure pertains should understand that the vaporizer 1 may further include general-purpose components other than the components illustrated in FIG. 1.

Also, not all the components 11 to 17 illustrated in FIG. 1 may be essential to the vaporizer 1. That is, in some other embodiments of the present disclosure, at least some of the components illustrated in FIG. 1 may be omitted or replaced with other components. Hereinafter, each component of the vaporizer 1 will be described.

The upper case 11 may serve as a cover or housing for an upper portion of the vaporizer 1. In some embodiments, the upper case 11 may also serve as a mouthpiece.

Next, the airflow tube 12 may serve as an airflow path for air and/or an aerosol. For example, an aerosol generated by the heating element 16 may be discharged in a direction toward the upper case through the airflow tube 12 and inhaled by the user. Although FIG. 1 illustrates that inhalation by the user is performed in a direction toward an upper end of the vaporizer 1, the shape of the airflow tube 12 and the delivery path may be changed according to the design of the aerosol generation device and/or the airflow tube 12.

Next, the liquid reservoir 13 may have a predetermined space where the aerosol-generating substrate in a liquid state may be stored. Also, the liquid reservoir 13 may supply the stored aerosol-generating substrate to the heating element 16 through the porous wick 15.

Next, the wick housing 14 may refer to a housing that is disposed between the liquid reservoir 13 and the porous wick 15 and surrounds at least a portion of the porous wick 15.

Next, the porous wick 15 may absorb the aerosol-generating substrate stored in the liquid reservoir 13 through a porous body and deliver the aerosol-generating substrate to the heating element 16. Although FIGS. 1 and 2 illustrate an example in which the porous wick 15 has an H-shaped body, the porous wick 15 may be designed and implemented in various other shapes. For example, as illustrated in the drawings such as FIG. 3, the porous wick 15 may be implemented to have a porous body having a shape similar to a rectangular parallelepiped shape.

In some embodiments, a coating film may be formed on at least a portion of the porous body. Preferably, a coating film may be formed on a surface that is not associated with a target transport path for a liquid among a plurality of surfaces forming the porous body. Here, the coating film may serve to block or limit liquid movement. As such, liquid may be concentrated in the target transport path. The present embodiment will be described in more detail below with reference to FIGS. 3 to 5.

Also, in some embodiments, the porous body may be formed by a plurality of beads. For example, a plurality of beads may be sphere-packed to form the porous body. According to the present embodiment, by packing the beads to form the porous body, a porous wick in which the distribution of pores is uniform may be manufactured, and accordingly, the liquid transport speed and amount of transported liquid in the porous wick may be guaranteed to be uniform. The present embodiment will be described in more detail below with reference to FIGS. 6 to 8.

The description of the components of the vaporizer 1 will be continued by referring back to FIGS. 1 and 2.

In some embodiments, the heating element 16 may include a heating pattern having a planar form and a terminal configured to receive electricity from a battery (not illustrated) (see FIG. 2). The heating pattern may be attached to or embedded in a lower portion of the body of the porous wick 15 and heat the absorbed liquid using a bottom heating method. In such a case, since the heating element 16 may evenly heat the liquid absorbed into the porous wick 15, the amount of the generated aerosol (that is, vapor production) may be significantly improved. The aerosol generated by heating may be inhaled by the user through the airflow tube 12 disposed above the porous wick 15.

Also, in some embodiments, the terminal may be disposed in such a way that the terminal comes in close contact with both side surfaces of the body of the porous wick 15 (see FIG. 2). In such a case, the space that the heating element 16 occupies may be minimized, and a problem in which the terminal interferes with an air flow and causes a decrease in the amount of generated aerosol may be alleviated.

Also, in some embodiments, the heating pattern may be embedded at a distance (depth) in a range of 0 to 400 μm from a surface of the lower portion of the body of the porous wick 15. Within this numerical range, the amount of generated aerosol may be maximized and a wick damage phenomenon may be minimized.

Next, the lower case 17 is a housing disposed at a lower portion of the vaporizer 1 and may serve to support the lower portion of the vaporizer 1, the porous wick 15, the heating element 16, and the like.

In some embodiments, an air hole or an airflow tube may be included in the lower case 17 to allow air to smoothly enter the heating element 16 (see FIG. 1).

Also, in some embodiments, a connection terminal configured to electrically connect the terminal of the heating element 16 to the battery (not illustrated) may be included in the lower case 17 (see FIG. 1).

The vaporizer 1 according to some embodiments of the present disclosure has been described above with reference to FIGS. 1 and 2. Hereinafter, a method of controlling a liquid transport path of the porous wick 15 will be described. For convenience of understanding, description will be continued assuming that the porous wick 15 has a body having a rectangular parallelepiped shape.

According to some embodiments of the present disclosure, a coating film may be formed on at least a portion of the body of the porous wick 15 to control the liquid transport path of the porous wick 15. More specifically, in order to control a liquid to be transported along a target transport path, a coating film may be formed on at least some of the plurality of surfaces forming the body of the porous wick 15.

Here, the coating film may serve to block or limit the transport (e.g., inflow, outflow) of liquid, and a position at which the coating film is formed may be determined on the basis of a target transport path (or transport direction) for the liquid. For example, the coating film may be formed on a surface that is not associated with the target transport path among the plurality of surfaces forming the body of the porous wick 15. For further convenience of understanding, additional description will be given with reference to examples illustrated in FIGS. 3 to 5. In each of FIGS. 3 to 5, on the right side is the planar development of the porous wick 15 shown on the left side.

For example, assume that the target transport direction for the liquid is as illustrated in FIG. 3. In such a case, the target transport path passes through two surfaces 152 and 154 among a plurality of surfaces 151 to 156 forming the body of the porous wick 15. Therefore, surfaces associated with the target transport path are the surfaces 152 and 154, and the coating film may be formed on the other surfaces 151, 153, 155, and 156 excluding the surfaces 152 and 154. In this way, the liquid may be controlled to be transported along the target transport path. For reference, since the destination of the target transport path is where the heating element 16 is present, the surface 154 associated with the heating element 16 is inevitably associated with the target transport path.

As another example, assume that the target transport direction for the liquid is as illustrated in FIG. 4. In such a case, the target transport path passes through the three surfaces 154 to 156 among the plurality of surfaces 151 to 156 forming the body of the porous wick 15. Therefore, surfaces associated with the target transport path are the surfaces 154 to 156, and the coating film may be formed on the other surfaces 151 to 153 excluding the surfaces 154 to 156. In this way, the liquid may be controlled to be transported along the target transport path.

As still another example, assume that the target transport direction is as illustrated in FIG. 5. In such a case, the target transport path passes through the three surfaces 151, 153, and 154 among the plurality of surfaces 151 to 156 forming the body of the porous wick 15. Therefore, surfaces associated with the target transport path are the surfaces 151, 153, and 154, and the coating film may be formed on the other surfaces 152, 155, and 156 excluding the surfaces 151, 153, and 154. In this way, the liquid may be controlled to be transported along the target transport path.

As mentioned above, the coating film may be formed using a material that is able to limit the transport of liquid or may be formed using a waterproof material, and the type of the coating film may vary according to embodiments.

In some embodiments, the coating film may be a glass film. In this case, the porous wick 15 may be formed through a first firing process in which the porous body is formed by firing and a second firing process in which a glass frit is applied on an outer surface of the body of the porous wick 15 and fired. Here, it may be preferable to use a glass frit that has a melting point lower than a firing temperature of the porous body. This is because, in a case in which the melting point of the glass frit is higher than the firing temperature of the porous structure, the outer surface of the porous body may melt in the second firing process. For example, preferably, the firing temperature of the porous body may exceed 800° C., and the melting point of the glass frit may be in a range of 600° C. to 800° C.

In some other embodiments, the coating film may be a polyimide coating film.

In still some other embodiments, the coating film may be a water-repellent coating film.

In yet some other embodiments, the coating film may be based on a combination of the previous embodiments. For example, the coating film may be implemented in the form of a double film including a glass film and a water-repellent coating film, and in this case, the waterproof performance of the coating film may be further improved.

In yet some other embodiments, the coating film may also be implemented using a membrane material that selectively blocks liquid permeation.

The method of controlling the liquid transport path of the porous wick 15 according to some embodiments of the present disclosure has been described above with reference to FIGS. 3 to 5. According to the above-described method, the coating film may be formed on some surfaces not associated with the target transport path among the plurality of surfaces forming the body of the porous wick 15. Accordingly, the liquid may be controlled to be intensively transported along the target transport path, and the liquid supply ability of the porous wick 15 and the vapor production of the vaporizer 1 (or aerosol generation device) may be significantly improved.

Hereinafter, a porous wick 15 made of a bead assembly according to some embodiments of the present disclosure will be described with reference to FIGS. 6 to 8.

FIG. 6 illustrates a process of manufacturing the porous wick 15.

As illustrated in FIG. 6, a plurality of beads 20 may be packed to manufacture porous wicks 15-1 and 15-2. For example, the plurality of beads 20 may be sphere-packed and fired to form bodies of the porous wicks 15-1 and 15-2. Examples of a bead packing structure may include a body-centered cubic (BCC) structure, a face-centered cubic (FCC) structure, and the like. However, various other packing structures may be utilized, and thus the scope of the present disclosure is not limited thereto. Since the BCC and FCC structures are widely known sphere packing structures in the art, description thereof will be omitted.

In a case in which the porous wick 15 is manufactured using a bead assembly, the porosity, pore size, pore distribution, and the like may be easily controlled by changing the bead size, packing method, and/or packing structure. For example, a porous wick in which the porosity is higher than or equal to a reference value and pore distribution is uniform may be easily manufactured, such that the manufactured porous wick may guarantee uniformity in the liquid transport speed and the amount of transported liquid.

The beads for the porous wick may be made of various materials. For example, the beads may be made of a ceramic, and ceramic beads may include glass ceramic beads or alumina ceramic beads. However, beads made of various other materials may be utilized, and thus the scope of the present disclosure is not limited to the above-listed examples.

Meanwhile, since the bead size (e.g., diameter) is associated with the liquid transport speed and the strength of the wick, it is important to appropriately determine the bead size. For example, as in the experimental results shown in FIGS. 7 and 8, as the bead diameter increases, the liquid transport speed of the wick increases whereas the strength of the wick decreases. This is because, as the bead diameter increases, the pore size increases while the number of beads per unit volume decreases, causing the number of contact interfaces during sintering to decrease. Therefore, in order to achieve both a proper strength and proper liquid transport speed of the wick, it may be important to appropriately determine the bead size.

In some embodiments, the bead diameter may be in a range of 10 μm to 300 μm. Preferably, the bead diameter may be in a range of 30 μm to 270 μm or 50 μm to 250 μm. More preferably, the bead diameter may be in a range of 60 μm to 100 μm, 65 μm to 90 μm, 70 μm to 95 μm, 75 μm to 90 μm, 80 μm to 95 μm, 75 μm to 85 μm, or 75 μm to 80 μm. Within such numerical ranges, a porous wick having an appropriate strength may be manufactured, and the liquid transport speed of the porous wick may also be improved as compared to a wick made of a fiber bundle.

Also, in some embodiments, the diameter distribution of the plurality of beads forming the porous wick may have a tolerance that is 30% of an average diameter. Preferably, the diameter distribution of the plurality of beads may have a tolerance that is 25%, 23%, or 21%. More preferably, the diameter distribution of the plurality of beads may have a tolerance that is 20%, 18%, 16%, 14%, 12%, or 10%. Still more preferably, the diameter distribution of the plurality of beads may have a tolerance that is 8%, 6%, or 5%. Since it is not easy to continuously manufacture beads having the same diameter, the cost required to manufacture the porous wick and the level of difficulty of manufacture may be significantly reduced by allowing the above tolerances. Furthermore, in a case in which the plurality of beads having the above tolerances are packed to manufacture a porous wick, a contact area between the beads increases, and thus the strength of the wick may also be improved.

In addition, the bead size and/or bead packing structure may be determined also on the basis of viscosity of a target aerosol-generating substrate. This is because, in order to guarantee a proper liquid transport speed for an aerosol-generating substrate having a high viscosity, there is a need to increase the porosity of the wick. Here, the target aerosol-generating substrate may refer to a substrate to be stored in a liquid reservoir. In some embodiments, a tolerance of the bead size may also be adjusted on the basis of the viscosity of the target aerosol-generating substrate. For example, in a case in which the viscosity of the target aerosol-generating substrate is higher than or equal to a reference value, the tolerance of the bead size may be adjusted to a smaller value. This is because, when the tolerance of the bead size becomes smaller, the pore size increases and thus the liquid transport speed may increase. In the opposite case, the tolerance of the bead size may be adjusted to a greater value.

In a case in which the porous wick is implemented using the bead assembly, the following various advantages may be obtained.

The first advantage is that the porous wick in which the pore size and pore distribution are uniform may be easily manufactured and the variation in quality of the wick may be minimized. Also, since the porous wick is able to guarantee uniformity in the liquid transport speed and the amount of transported liquid, a burnt taste and damage to a wick may also be minimized.

The second advantage is that physical characteristics (e.g., porosity, pore size, pore distribution, strength) of the porous wick may be easily controlled. This means that the liquid transport ability of the wick may be controlled, because the physical characteristics of the porous wick are closely associated with the liquid transport ability (e.g., transport speed, transport amount). For example, controllable factors such as the bead size, bead packing method, and/or bead packing structure may be adjusted to control the liquid transport ability of the porous wick.

Meanwhile, the vapor production (that is, amount of generated aerosol) of the aerosol generation device depends on performance (e.g., heat amount) of the heating element and the liquid transport ability of the wick. Even if the performance of the heating element is excellent, the liquid may burn out due to instantaneous liquid depletion when the liquid transport ability of the wick is poor. Also, in a case in which the liquid transport ability of the wick is superior to the performance of the heating element, a liquid that did not vaporize may remain on the surface of the wick and cause a leakage of the liquid. Therefore, it is important that the liquid transport ability of the wick and the performance of the heating element are controlled to be balanced, but while it is easy to control the performance of the heating element, it is not easy to control the liquid transport ability of the wick. In this respect, the porous wick implemented using the bead assembly may improve the vapor production most effectively, because the liquid transport ability can be easily controlled.

Meanwhile, in some other embodiments of the present disclosure, without using the coating film, the bead size, bead packing structure, or the like of the porous wick 15 may be changed to control the liquid transport path.

For example, beads having a smaller size may be applied to surfaces that are not associated with the target transport path among the plurality of surfaces forming the body of the porous wick 15. In such a case, since the pore size is smaller on the surfaces not associated with the target transport path, the transport of liquid through these surfaces may be limited.

As another example, a denser bead packing structure may be applied to surfaces that are not associated with the target transport path among the plurality of surfaces forming the body of the porous wick 15. In such a case, since the porosity is smaller on the surfaces not associated with the target transport path, the transport of liquid through these surfaces may be limited.

As still another example, a bead assembly with a larger bead size tolerance may be applied to surfaces that are not associated with the target transport path among the plurality of surfaces forming the body of the porous wick 15. In such a case, since the porosity and pore size are smaller on the surfaces not associated with the target transport path, the transport of liquid through these surfaces may be limited.

The porous wick 15 made of the bead assembly according to some embodiments of the present disclosure has been described above with reference to FIGS. 6 to 8. Hereinafter, aerosol generation devices 100-1 to 100-3 to which the vaporizer 1 according to an embodiment is applied will be described with reference to FIGS. 9 to 11.

FIGS. 9 to 11 are exemplary block diagrams illustrating the aerosol generation devices 100-1 to 100-3. Specifically, FIG. 9 illustrates a liquid-type aerosol generation device 100-1, and FIGS. 10 and 11 illustrate hybrid-type aerosol generation devices 100-2 and 100-3 that use a liquid and a cigarette together.

As illustrated in FIG. 9, the aerosol generation device 100-1 may include a mouthpiece 110, the vaporizer 1, a battery 130, and a controller 120. However, this is merely a preferred embodiment for achieving the objectives of the present disclosure, and of course, some components may be added or omitted as necessary. Also, the components of the aerosol generation device 100-1 illustrated in FIG. 9 represent functional components that are functionally distinct, and the plurality of components may be implemented to be integrated with each other in an actual physical environment, or a single component may be implemented to be divided into a plurality of specific functional components. Hereinafter, each component of the aerosol generation device 100-1 will be described.

The mouthpiece 110 may be disposed at one end of the aerosol generation device 100-1 and come in contact with an oral region of a user so that the user may inhale an aerosol generated from the vaporizer 1. In some embodiments, the mouthpiece 110 may be a component of the vaporizer 1.

Next, the vaporizer 1 may vaporize an aerosol-generating substrate in a liquid state to generate an aerosol. In order to avoid repeated description, the description of the vaporizer 1 will be omitted.

Next, the battery 130 may supply power used to operate the aerosol generation device 100-1. For example, the battery 130 may supply power to allow the heating element 16 of the vaporizer 1 to heat an aerosol-generating substrate and may supply power required for the controller 120 to operate.

Also, the battery 130 may supply power required to operate electrical components such as a display (not illustrated), a sensor (not illustrated), and a motor (not illustrated) which are installed in the aerosol generation device 100-1.

Next, the controller 120 may control the overall operation of the aerosol generation device 100-1. For example, the controller 120 may control the operation of the vaporizer 1 and the battery 130 and also control the operation of other components included in the aerosol generation device 100-1. The controller 120 may control power supplied by the battery 130, a heating temperature of the heating element 16 included in the vaporizer 1, and the like. Also, the controller 120 may check a state of each component of the aerosol generation device 100-1 and determine whether the aerosol generation device 100-1 is in an operable state.

The controller 120 may be implemented by at least one processor. The processor may also be implemented with an array of a plurality of logic gates or implemented with a combination of a general-purpose microprocessor and a memory which stores a program that may be executed by the microprocessor. Also, those of ordinary skill in the art to which the present disclosure pertains should understand that the controller 120 may also be implemented with other forms of hardware.

Meanwhile, in some embodiments, the aerosol generation device 100-1 may further include an input unit (not illustrated) to receive a user input. The input unit may be implemented with a switch or a button, but the scope of the present disclosure is not limited thereto. In the present embodiment, the controller 120 may control the aerosol generation device 100-1 in response to a user input received through the input unit. For example, the controller 120 may control the aerosol generation device 100-1 to generate an aerosol as the user operates a switch or a button.

Hereinafter, the hybrid-type aerosol generation devices 100-2 and 100-3 will be briefly described with reference to FIGS. 10 and 11.

FIG. 10 illustrates the aerosol generation device 100-2 in which the vaporizer 1 and a cigarette 150 are arranged in parallel, and FIG. 11 illustrates the aerosol generation device 100-3 in which the vaporizer 1 and the cigarette 150 are arranged in series. However, the inner structures of the aerosol generation devices to which the vaporizer 1 according to an embodiment of the present disclosure is applied are not limited to those illustrated in FIGS. 10 and 11, and the arrangement of the components may be changed according to design methods.

In FIGS. 10 and 11, the aerosol generation devices 100-2 and 100-3 may further include a heater 140 configured to heat the cigarette 150. The heater 140 may be disposed around the cigarette 150 to heat the cigarette 150. For example, the heater 140 may be an electric resistive heater but is not limited thereto. The heater 140 or a heating temperature of the heater 140 may be controlled by the controller 120. The aerosol generated by the vaporizer 1 may pass through the cigarette 150 and be inhaled into the oral region of the user.

Various types of aerosol generation devices 100-1 to 100-3 to which the vaporizer 1 according to some embodiments of the present disclosure may be applied have been described above with reference to FIGS. 9 to 11.

All the components constituting the embodiments of the present disclosure have been described above as being combined into one body or being operated in combination, but the technical idea of the present disclosure is not necessarily limited to the embodiments. That is, any one or more of the components may be selectively operated in combination within the intended scope of the present disclosure.

The embodiments of the present disclosure have been described above with reference to the accompanying drawings, but those of ordinary skill in the art to which the present disclosure pertains should understand that the present disclosure may be embodied in other specific forms without changing the technical idea or essential features thereof. Therefore, the embodiments described above should be understood as being illustrative, instead of limiting, in all aspects. The scope of the present disclosure should be interpreted by the claims below, and any technical idea within the scope equivalent to the claims should be interpreted as falling within the scope of the technical idea defined by the present disclosure.

What is claimed is:

1. A vaporizer comprising:

a liquid reservoir having a space inside and configured to store an aerosol-generating substrate in a liquid state in the space;

a heating element configured to heat the stored aerosol-generating substrate to generate an aerosol and including a heating pattern; and a porous wick comprising a porous body, the porous wick being configured to absorb the aerosol-generating substrate stored in the liquid reservoir and to deliver the stored aerosol-generating substrate to the heating element through the porous body, and the porous wick comprising a coating film formed on part of a plurality of surfaces of the porous body, wherein the coating film is formed only on those surfaces that are not associated with a target transport path for the aerosol-generating substrate in the liquid state, wherein a destination of the target transport path is where the heating element is present, and wherein the heating pattern has a planar form and is attached to or embedded in a lower portion of the porous wick such that the aerosol-generating substrate in the liquid state absorbed in the porous wick is heated using bottom heating, wherein the coating film is configured to serve to block or limit the aerosol-generating substrate in the liquid state movement, wherein the coating film is a glass film formed by a waterproof material, and wherein the heating pattern is arranged such that a plane of the heating pattern is parallel to vertical direction.

2. The vaporizer of claim 1, wherein the part of the plurality of surfaces includes at least one surface that is not associated with the target transport path for the aerosol-generating substrate.

3. The vaporizer of claim 1, wherein the heating pattern is disposed on at least one surface of the plurality of surfaces, and the part of the plurality of surfaces includes a surface on which the heating pattern is not disposed.

4. The vaporizer of claim 1, wherein the porous wick is manufactured through a first firing process in which the porous body is fired and a second firing process in which a glass frit is applied on the part of the plurality of surfaces and fired.

5. The vaporizer of claim 1, wherein the porous body is formed by beads.

6. The vaporizer of claim 5, wherein the beads are ceramic beads.

7. The vaporizer of claim 5, wherein a diameter of the beads is in a range of 70 μm to 100 μm.

8. The vaporizer of claim 5, wherein a diameter distribution of the beads has a tolerance that is 20% of an average diameter.

9. The vaporizer of claim 1, further comprising an airflow tube disposed above the porous wick and configured to deliver the generated aerosol.

10. The vaporizer of claim 1, wherein:

the heating pattern is embedded at a depth in a range of 0 μm to 400 μm from a surface of the lower portion of the porous body.

11. The vaporizer of claim 1, wherein:

the heat generated by the heating element is conducted to the aerosol-generating substrate in a liquid state absorbed in the porous body, and the aerosol-generating substrate in a liquid state absorbed in the porous body is heated by the conducted heat to generate the aerosol.

* * * * *